United States Patent [19]

Phelps

[11] 4,120,088

[45] Oct. 17, 1978

[54] KEY-LOCK KNIFE

[76] Inventor: Paul S. Phelps, 1306 Woodlawn Dr., Maryville, Tenn. 37801

[21] Appl. No.: 840,611

[22] Filed: Oct. 11, 1977

[51] Int. Cl.[2] ..... B26B 1/04

[52] U.S. Cl. ..... 30/160

[58] Field of Search ..... 30/158, 159, 160, 161, 30/155

[56] References Cited

U.S. PATENT DOCUMENTS

| | | | |
|---|---|---|---|
| 633,854 | 9/1899 | Huhn | 30/160 |
| 847,474 | 3/1907 | Hawley | 30/158 |
| 3,930,309 | 1/1976 | Collins | 30/161 |
| 3,942,249 | 3/1976 | Poehlmann | 30/160 |

*Primary Examiner*—Jimmy C. Peters
*Attorney, Agent, or Firm*—Martin J. Skinner

[57] ABSTRACT

The construction of a folding-blade pocket knife or the like is described having an improved means for mechanically assisting the movement of the blade from a closed position to an open position or the reverse. The means includes a turning handle pivoted to an exposed portion of a blade pivot and a spring-loaded detent element in cooperation with specifically located indentations in the turning handle. Furthermore, a locking lug on the turning handle is provided to cooperate with a recess in the knife handle to prevent unintentional movement of the knife blade.

3 Claims, 6 Drawing Figures

KEY-LOCK KNIFE

BACKGROUND OF THE INVENTION

My invention relates generally to foldable pocket knives and the like, and more particularly to a knife having means for assisting the movement of one or more knife blades from a closed position to an open position and the reverse.

In general terms pocket knives and the like, wherein a blade or blades are stored within a handle during non-use, require a greater force to open when the blades are larger and larger. This is brought about the need to overcome a stiff back spring of such knives. Accordingly, for large folding knives, means have occasionally been provided to mechanically assist pivoting the blade or blades from a closed position within the handle to an open position generally causing the blade to extend from the handle to an inline relationship.

One knife construction with means for assisting in the movement of a blade is that described in U.S. Pat. No. 364,414, issued to C. Hollweg on June 7, 1887. In this patent a blade has a usual aperture for a pivot together with a second aperture for engagement with a turning mechanism. Further, there is a turning plate which is operated by a folding key-type turning handle. The turning handle has a pair of recesses which cooperated with lugs on a locking plate when the turning handle is folded against the knife handle, i.e., the locking plate on the handle.

Another patent having a blade-assisting mechanism is U.S. Pat. No. 633,854 issued to Ernst Kuhn on Sept. 26, 1899. In this patent, a single blade is shown with the blade pivot extending perpendicularly from the exterior of the knife handle. The blade appears to be nonrotatably attached to the pivot. Exterior of the handle, a bent wire-like key passes transversely through the pivot. The key can be folded back against the surface of the knife handle whereby it engages a knobbed projection on the knife handle. This locking feature, as in the first-cited patent, is designed to prevent inadvertent closing of the knife blade during use. As well, such locking prevents inadvertent opening of the knife.

SUMMARY OF THE INVENTION

In my invention, wherein the knife blade is non-rotatably attached to a pivot pin, the pin extending external to the handle, I use a keytype turning handle pivoted in the exposed end of the pivot pin. The exposed end of the pivot pin contains a spring-loaded detent that cooperates with depressions on the turning handle at specific orientations of the turning handle. Furthermore, the turning handle is provided with a pair of wedge-shaped protuberances oriented whereby one proturberance will engage with a recess in the surface of the knife handle when the turning handle is depressed against the knife handle and thus lock the knife blade in either an open or closed position.

BRIEF REFERENCE TO THE FIGURES

SPECIFIC EMBODIMENT

Figure 1:
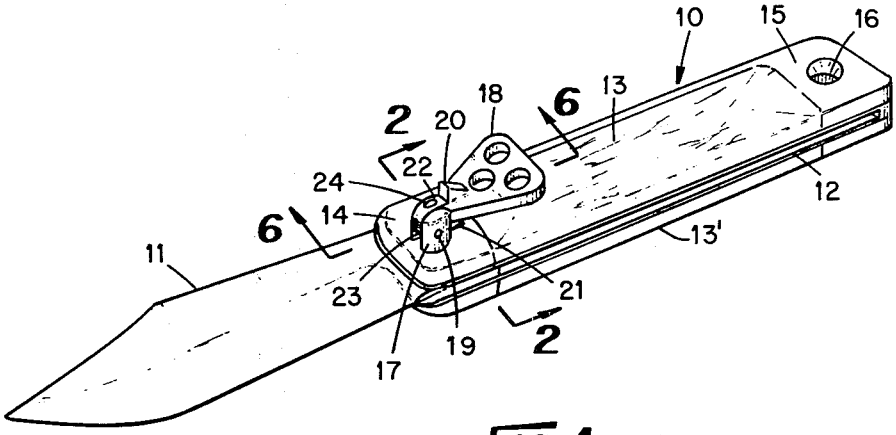
FIG. 1 is an isometric drawing of my improved knife structure.

Referring to FIG. 1, my knife comprises a handle unit 10 and a blade 11. The handle unit is made up of a conventional metal liner 12, side handle inserts 13, 13' and metal end bolsters 14, 15. These components are held together, in a conventional manner, with rivets (not shown). One bolster (15) is shown having an aperture 16 to attach a lanyard (not shown): this construction is optional. The metal liner 12 provides a pocket into which the blade 11 may be moved in a closed position. The inserts 13, 13' may be plastic, bone, or other suitable materials.

The blade 11 is attached to the handle 10 with a pivot 17 which projects through bolster 14. As shown, the end of the pivot 17 is slotted to receive the shank of a key-shaped element 18 hereinafter referred to as a key. A pin 19 pivotally connects the key 18 to the pivot 17. Extending from the key 18, in directions generally perpendicular to pin 19, are a pair of wedge-shaped protuberances or lugs 20, 21. These protuberances are located near the shank 22 of the key 18 whereby one or the other may engage a recess (not seen in this figure) in the surface of bolster 14. The shank 22 of the key has a cylindrical end surface 23 which is provided with three spherical depressions 24 (one shown) each located at positions 90° from each other on the cylindrical surface 23.

Figure 2:
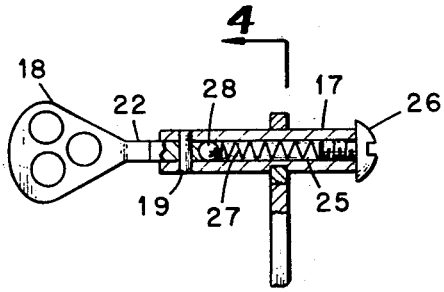
FIG. 2 is a cross sectional view, taken at 2—2 of FIG. 1, of the pivot pin construction of my knife.
Figure 3:
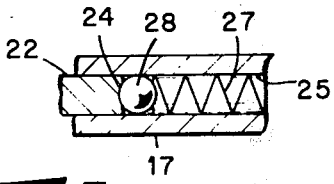
FIG. 3 is an enlarged cross section of the view of FIG. 2.

Greater detail of the pivot and key are shown in FIG. 2. The pivot 17 is provided with an axial bore 25 closed at one end with a threaded element 26. The head of the threaded element is exterior to but abutting bolster 14 (not shown). A spiral spring 27 is positioned within bore 25 to bear against a spherical ball 28 near a second end of bore 25. The spring 27 and ball 28 thus form a detent unit to engage one of the spherical depressions (e.g., 24) on the shank 22 of the key 18. An enlarged view of this detent is shown in FIG. 3.

Figure 4:
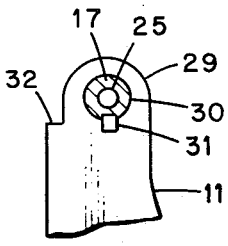
FIG. 4 is a cross sectional view, taken at 4—4 of FIG. 2, showing a means for non-rotatable engagement of a knife blade with the pivot pin of my knife.

A transverse section through the pivot is shown in FIG. 4. The blade 11, at its tang 29, is provided with an aperture 30 to permit passage of the pivot 17. In addition, a radially-extending notch in this aperture and a corresponding inward recess in pivot 17 accommodates a stud 31 whereby rotation of pivot 17 causes a corresponding rotation of blade 11 about the axis of pivot 17. The tang 29 is provided with a shoulder 32 to bear against a stop (not shown) within liner 12.

Figure 5:
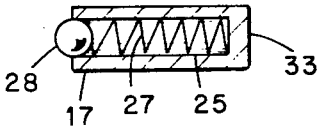
FIG. 5 is another embodiment of the pivot pin of my knife.

Another embodiment of the pivot-detent unit is shown in FIG. 5. The bore 25 of pivot 17 is closed at the end opposite the key 18 with an integral wall 33. In this embodiment, spring 27 is inserted in bore 25 from the key end, followed by the ball 28. Thereafter, the shank 22 of the key 18 is attached using pin 19.

Figure 6:
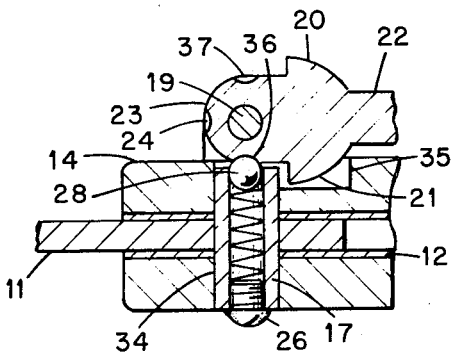
FIG. 6 is a sectional view of a portion of the knife handle, taken at 6—6 of FIG. 1, more clearly illustrating a locking system for my knife blade.

FIG. 6 illustrates, in more detail, the locking means of the afore-described key 18. This is a sectional view of the bolster 14 on the end of the knife handle 10. A passageway 34 extends transversely through the handle 11 and bolster 14. It is through this passageway 34 that pivot 17 normally extends. The bolster 14 is provided with a recess 35. This recess may communicate with the passageway 34, as shown, or may be separate therefrom. The position of recess 35 is spaced from the axis of passageway 34 a distance equal to the spacing between pin 19 and lug 20 (see FIG. 1) and oriented from passageway 34 in a direction along the length of the knife handle 10. Preferably, the recess is positioned in a direction opposite the blade end of the handle 10. However, the recess 35, or a second recess (not shown) may be positioned in a direction toward the blade end of the handle 10.

Referring again to FIG. 1, in conjuncation with FIG. 6, my knife is operated as follows. In the position shown, the blade 11 is fully extended and the key 18 is pivoted about pin 19 so as to be substantially juxtaposed against the handle surface 13. In this position of the key 18, lug 21 is inserted in recess 35 so as to prevent inadvertent movement of the blade 11. Also in this position, the aforementioned ball 28 is in communication with depression 36 (FIG. 6) to minimize inadvertent elevation of the key 18 which would unlock lug 21 and recess 35.

When the blade 11 is to be moved so as to be enclosed within the liner 12, the key 18 is raised to a vertical orientation with respect to the surface of bolster 14. In this position the ball 28 of the detent unit engages depression 24 and the lug 21 is disengaged from recess 35. Thereafter key 18 is rotated counterclockwise about the axis of the pivot 17 whereby blade 11 is rotated about the axis of pivot 17 until contained within liner 12. This requires 180° rotation of the key 18. The blade 11 is locked in this position by again returning the key 18 to a position juxtaposed against the handle surface 13. In this position the ball of the detent unit engages depression 37 and lug 20 locks into recess 35. Accordingly, the blade cannot inadvertently move out of the liner 12.

It will be apparent that my knife can be assembled with the key 18 and locking mechanisms on the reverse side of bolster 14. The only difference in operation would be the rotation of key in a clockwise direction to close the blade, and in a counterclockwise direction to open the blade.

Furthermore, it will be apparent that, if desired, a second key and locking mechanism may be included at the second end of the knife for use with a second blade. In such an embodiment, this additional mechanism would be located at the position indicated in FIG. 1 as an aperture 16 for a lanyard.

I claim:

1. An improved knife of the type wherein a blade is secured to a rotatable blade pivot passing transversely through a knife handle, and a turning key is connected to said blade pivot exterior to said knife handle with a second pivot whereby said blade may be moved from a position within said knife handle to an extended position substantially aligned with said knife handle, the improvement which comprises:

said blade pivot being provided with an axial bore, said bore having a closure at an end opposite said turning key;

a detent element mounted coaxially within said bore, wherein said detent element comprises a helical spring within said bore in contact with said closure and a spherical ball at a second end of said bore in contact with said spring; and a cylindrical end surface on said turning key having an axis coexistent with an axis of said second pivot, said cylindrical surface being provided with a plurality of semispherical depressions to receive a portion of said spherical ball in specific pivoted positions of said turning key about the axis of said second pivot.

2. The knife of claim 1 wherein said knife handle is provided with a surface recess adjacent said blade pivot, and further comprises at least one projection on said turning key to engage said surface recess when said turning key is pivoted about said second pivot to lie against said knife handle and engage said ball with one of said depressions.

3. The knife of claim 1 wherein said turning key is substantially flat in a plane passing through the axis of said second pivot and said projection extends perpendicularly from the plane of said turning key.

* * * * *